US009073689B2

(12) United States Patent
Files et al.

(10) Patent No.: US 9,073,689 B2
(45) Date of Patent: Jul. 7, 2015

(54) MICROWAVE ENERGY INTERACTIVE INSULATING STRUCTURE

(75) Inventors: John Cameron Files, Vancouver, WA (US); Scott W. Middleton, Oshkosh, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 1490 days.

(21) Appl. No.: 12/070,091

(22) Filed: Feb. 15, 2008

(65) Prior Publication Data

US 2008/0197128 A1 Aug. 21, 2008

Related U.S. Application Data

(60) Provisional application No. 60/890,056, filed on Feb. 15, 2007, provisional application No. 60/903,904, filed on Feb. 28, 2007.

(51) Int. Cl.

| | |
|---|---|
| ***H05B 6/80*** | (2006.01) |
| ***H05B 6/64*** | (2006.01) |
| ***B32B 1/02*** | (2006.01) |
| ***B65D 81/34*** | (2006.01) |

(52) U.S. Cl.

CPC .... *B65D 81/3446* (2013.01); *B65D 2581/3445* (2013.01); *B65D 2581/3447* (2013.01); *B65D 2581/3472* (2013.01); *B65D 2581/3477* (2013.01); *B65D 2581/3479* (2013.01); *B65D 2581/3494* (2013.01)

(58) Field of Classification Search

CPC ..... B65D 81/3446; B65D 2581/3494; B65D 2581/3445; B65D 2581/3479; B65D 2581/3472; B65D 2581/3477; B65D 2581/3447

USPC ..... 219/730, 725, 729, 732, 734, 756, 759, 219/762; 426/520, 107, 113, 234, 243, 549; 428/580, 35.7, 35.2

See application file for complete search history.

(56) References Cited

U.S. PATENT DOCUMENTS

| | | | |
|---|---|---|---|
| 3,098,583 | A | 7/1963 | Sherman et al. |
| 3,439,428 | A | 4/1969 | Zelnick |
| 3,595,468 | A | 7/1971 | Repko |
| 3,601,252 | A | 8/1971 | Sager |
| 3,967,998 | A | 7/1976 | Kane |

(Continued)

FOREIGN PATENT DOCUMENTS

| | | |
|---|---|---|
| EP | 0 312 333 | 4/1989 |
| EP | 0 421 710 A2 | 10/1991 |

(Continued)

OTHER PUBLICATIONS

PCT/US2009/038178—International Search Report.

(Continued)

*Primary Examiner* — Quang Van

(74) *Attorney, Agent, or Firm* — Womble Carlyle Sandridge & Rice, LLP

(57) ABSTRACT

A microwave energy interactive structure for heating, browning, and/or crisping a food item in a microwave oven includes a plurality of layers including a layer of microwave energy interactive material and a substantially continuous tie layer. The tie layer includes a thermoplastic material. Upon sufficient exposure to microwave energy, the tie layer softens and allows the adjacent layers to separate from one another to define a void between the respective layers.

45 Claims, 1 Drawing Sheet

(56) References Cited

U.S. PATENT DOCUMENTS 3,973,045 A 8/1976 Brandberg et al.
4,013,798 A 3/1977 Goltsos
4,132,811 A 1/1979 Standing et al.
4,196,331 A 4/1980 Leveckis et al.
4,220,684 A 9/1980 Olson
4,260,060 A 4/1981 Faller
4,267,420 A 5/1981 Brastad
4,267,955 A 5/1981 Struble
4,268,738 A 5/1981 Flautt, Jr. et al.
4,283,427 A 8/1981 Winters et al.
4,286,136 A 8/1981 Mason, Jr.
4,461,031 A 7/1984 Blamer
4,571,337 A 2/1986 Cage et al.
4,574,174 A 3/1986 McGonigle
4,641,005 A 2/1987 Seiferth
4,691,374 A 9/1987 Watkins et al.
4,745,249 A 5/1988 Daniels
4,775,771 A 10/1988 Pawlowski et al.
4,777,053 A 10/1988 Tobelmann et al.
4,785,937 A 11/1988 Tamezawa et al.
4,786,513 A 11/1988 Monforton et al.
4,825,025 A 4/1989 Seiferth
4,848,931 A 7/1989 Kamada et al.
4,851,632 A 7/1989 Kaliski
4,865,921 A 9/1989 Hollenberg
4,883,936 A 11/1989 Maynard et al.
4,890,439 A 1/1990 Smart
4,894,247 A 1/1990 Fong
4,911,938 A 3/1990 Fisher et al.
4,914,266 A 4/1990 Parks et al.
4,916,280 A 4/1990 Havette
4,933,193 A 6/1990 Fisher
4,936,935 A 6/1990 Beckett
4,943,456 A 7/1990 Pollart et al.
4,950,859 A 8/1990 Anderson
4,962,293 A 10/1990 Lackey
4,963,424 A 10/1990 Beckett
4,968,865 A 11/1990 Seaborne
4,970,358 A 11/1990 Brandberg et al.
4,970,360 A 11/1990 Pesheck et al.
4,973,810 A 11/1990 Brauner
5,003,142 A 3/1991 Fuller
5,006,684 A 4/1991 Wendt et al.
5,039,364 A 8/1991 Beckett
5,041,295 A 8/1991 Perry et al.
5,041,325 A 8/1991 Larson et al.
5,044,777 A 9/1991 Watkins et al.
5,053,594 A 10/1991 Thota et al.
5,059,279 A 10/1991 Wilson
5,070,173 A 12/1991 Yokota et al.
5,077,455 A 12/1991 Peleg et al.
5,081,330 A 1/1992 Brandberg et al.
5,084,601 A 1/1992 Andreas et al.
5,097,107 A 3/1992 Watkins et al.
5,117,078 A 5/1992 Beckett
5,124,519 A 6/1992 Roy et al.
5,157,817 A * 10/1992 Davidian ..... 27/35
5,164,562 A 11/1992 Huffman et al.
5,177,332 A 1/1993 Fong
5,180,894 A 1/1993 Quick et al.
5,189,272 A 2/1993 McDonald et al.
5,213,902 A 5/1993 Beckett
5,217,768 A 6/1993 Walters et al.
5,221,419 A 6/1993 Beckett
5,230,914 A 7/1993 Akervik
5,231,268 A 7/1993 Hall et al.
5,239,153 A 8/1993 Beckett
5,241,150 A 8/1993 Garvey et al.
5,256,846 A 10/1993 Walters
5,260,536 A 11/1993 Peery
5,260,537 A 11/1993 Beckett
5,266,386 A 11/1993 Beckett
5,294,763 A 3/1994 Chamberlain et al.
5,294,765 A 3/1994 Archibald et al.
5,298,708 A 3/1994 Babu et al.
5,317,118 A 5/1994 Brandberg et al.
RE34,683 E 8/1994 Maynard
5,338,921 A 8/1994 Maheux et al.
5,340,436 A 8/1994 Beckett
5,354,973 A 10/1994 Beckett
5,357,086 A 10/1994 Turpin et al.
5,389,767 A 2/1995 Dobry
5,405,663 A 4/1995 Archibald et al.
5,410,135 A 4/1995 Pollart
5,424,517 A 6/1995 Habeger
5,428,209 A 6/1995 Babu et al.
5,446,270 A 8/1995 Chamberlain et al.
5,484,984 A 1/1996 Gics
5,489,766 A 2/1996 Walters et al.
5,510,132 A 4/1996 Gallo, Jr.
5,514,854 A 5/1996 Atsaves
5,519,195 A 5/1996 Keefer
5,543,606 A 8/1996 Gics
5,565,125 A 10/1996 Parks
5,628,921 A 5/1997 Beckett
5,630,959 A 5/1997 Owens
5,672,407 A 9/1997 Beckett
5,688,427 A 11/1997 Gallo, Jr.
5,690,853 A 11/1997 Jackson et al.
5,759,422 A 6/1998 Schmelzer
5,773,801 A 6/1998 Blamer et al.
5,780,824 A 7/1998 Matos
5,800,724 A 9/1998 Habeger
5,916,470 A 6/1999 Besser et al.
5,921,681 A 7/1999 Money
5,932,680 A 8/1999 Heider
5,965,662 A 10/1999 Krebs et al.
5,994,685 A 11/1999 Jackson et al.
6,005,234 A 12/1999 Moseley et al.
6,016,950 A 1/2000 Money
6,060,096 A 5/2000 Hanson et al.
6,090,706 A 7/2000 Telford et al.
6,093,920 A 7/2000 Beckwith
6,100,513 A 8/2000 Jackson et al.
6,114,679 A 9/2000 Lai
6,133,560 A 10/2000 Zeng et al.
6,137,098 A 10/2000 Moseley et al.
6,150,646 A 11/2000 Lai
6,204,492 B1 3/2001 Zeng
6,251,451 B1 6/2001 Zeng
6,303,913 B1 10/2001 Bono et al.
6,303,914 B1 10/2001 Bono et al.
6,335,042 B1 1/2002 Money
6,359,272 B1 3/2002 Sadek et al.
6,414,288 B1 7/2002 Bono et al.
6,414,290 B1 7/2002 Cole
6,431,365 B1 8/2002 Money
6,433,322 B2 8/2002 Zeng
6,436,457 B1 8/2002 Poss
6,455,827 B2 9/2002 Zeng
6,486,455 B1 11/2002 Merabet
6,488,973 B1 12/2002 Wright
6,501,059 B1 12/2002 Mast
6,552,315 B2 4/2003 Zeng
6,677,563 B2 1/2004 Lai
6,683,289 B2 1/2004 Whitmore et al.
6,717,121 B2 4/2004 Zeng
6,744,028 B2 6/2004 Chisholm et al.
6,765,182 B2 7/2004 Cole
6,896,919 B2 5/2005 Wright
7,015,442 B2 3/2006 Tucker, Jr. et al.
7,019,271 B2 3/2006 Wnek et al.
7,038,182 B2 5/2006 Young et al.
7,351,942 B2 4/2008 Wnek et al.
7,365,292 B2 4/2008 Cole et al.
7,541,562 B2 6/2009 Cole et al.
7,812,293 B2 10/2010 Su et al.
7,868,274 B2 1/2011 Bohme et al.
7,923,669 B2 4/2011 Wnek et al.
2003/0017235 A1 1/2003 Wright
2003/0071036 A1 4/2003 Savage et al.
2003/0111463 A1 6/2003 Lai
2003/0206997 A1 11/2003 Winkelman et al.
2004/0022984 A1 2/2004 Abe et al.

(56) References Cited

U.S. PATENT DOCUMENTS

| | | | | |
|---|---|---|---|---|
| 2004/0052993 | A1 | 3/2004 | Dawes | |
| 2004/0130788 | A1 | 7/2004 | Minami | |
| 2004/0171767 | A1 | 9/2004 | Pohlmann et al. | |
| 2004/0173607 | A1 | 9/2004 | Blankenbeckler et al. | |
| 2005/0079252 | A1 | 4/2005 | Kendig et al. | |
| 2005/0173425 | A1 | 8/2005 | Wnek et al. | |
| 2005/0205565 | A1 | 9/2005 | Cole et al. | |
| 2005/0267245 | A1 | 12/2005 | Sandusky et al. | |
| 2006/0049190 | A1* | 3/2006 | Middleton et al. | 219/730 |
| 2006/0113300 | A1 | 6/2006 | Wnek et al. | |
| 2006/0252865 | A1* | 11/2006 | Bush et al. | 524/356 |
| 2006/0289521 | A1 | 12/2006 | Bohme et al. | |
| 2007/0023426 | A1 | 2/2007 | Russell et al. | |
| 2007/0215610 | A1 | 9/2007 | Su et al. | |
| 2008/0032100 | A1* | 2/2008 | Tsukuda et al. | 428/212 |
| 2008/0047958 | A1 | 2/2008 | Cole et al. | |
| 2008/0078759 | A1 | 4/2008 | Wnek et al. | |
| 2008/0081095 | A1 | 4/2008 | Cole et al. | |
| 2008/0105688 | A1 | 5/2008 | Hopkins | |
| 2008/0135544 | A1 | 6/2008 | Lafferty et al. | |
| 2008/0146749 | A1 | 6/2008 | Pohlmann et al. | |
| 2008/0197128 | A1 | 8/2008 | Files et al. | |
| 2008/0214339 | A1 | 9/2008 | McInnis et al. | |
| 2008/0241529 | A1 | 10/2008 | Bauer et al. | |
| 2008/0280145 | A1 | 11/2008 | Paschkowski et al. | |
| 2009/0061053 | A1 | 3/2009 | Gaylor et al. | |
| 2009/0120929 | A1 | 5/2009 | Lafferty | |
| 2009/0242550 | A1 | 10/2009 | Schneider | |
| 2010/0072197 | A1 | 3/2010 | Neff et al. | |
| 2010/0260900 | A1 | 10/2010 | DeVerney et al. | |
| 2011/0147377 | A1 | 6/2011 | Wnek et al. | |
| 2011/0226761 | A1 | 9/2011 | Romeo et al. | |
| 2011/0233202 | A1 | 9/2011 | Robison et al. | |

FOREIGN PATENT DOCUMENTS

| | | |
|---|---|---|
| GB | 2 207 589 A | 2/1989 |
| JP | H05-504650 | 7/1993 |
| JP | 6-508878 | 10/1994 |
| JP | 7-505109 | 6/1995 |
| JP | 2001-139069 | 5/2001 |
| WO | WO 91/07861 | 5/1991 |
| WO | WO 91/10337 | 7/1991 |
| WO | WO 92/09503 | 6/1992 |
| WO | WO 93/01247 | 1/1993 |
| WO | WO 93/19566 | 9/1993 |
| WO | WO 97/11010 | 3/1997 |
| WO | WO 97/26778 | 7/1997 |
| WO | WO 00/50318 | 8/2000 |
| WO | WO 03/053106 | 6/2003 |
| WO | WO 2005/077783 | 8/2005 |
| WO | WO 2006/113403 | 10/2006 |
| WO | WO 2009/120739 | 10/2009 |

OTHER PUBLICATIONS

PCT/US2009/038178—Written Opinion.

PCT/US2003/003779—International Search Report, Jul. 29, 2003, Graphic Packaging International, Inc.

PCT/US2003/003779—International Preliminary Examination Report, Feb. 12, 2004, Graphic Packaging International, Inc.

PCT/US05/04148—International Preliminary Report on Patentability, Jan. 31, 2006, Graphic Packaging International, Inc.

PCT/2009/038178—International Search Report and Written Opinion, Sep. 25, 2009, Graphic Packaging International, Inc.

PCT/2009/038178—International Preliminary Report on Patentability, Sep. 28, 2010, Graphic Packaging International, Inc.

PCT/US2005/004148—International Search Report, Jul. 7, 2005, Graphic Packaging International, Inc.

PCT/US2005/004148—Written Opinion, Jul. 7, 2005, Graphic Packaging International, Inc.

PCT/US06/014010—International Search Report, Dec. 4, 2007, Graphic Packaging International, Inc.

PCT/US06/014010—Written Opinion, Dec. 4, 2007, Graphic Packaging International, Inc.

PCT/US03/03779—International Search Report, Jul. 29, 2003, Graphic Packaging Corporation.

PCT/US03/03779—Written Opinion, Jul. 29, 2003, Graphic Packaging Corporation.

* cited by examiner

MICROWAVE ENERGY INTERACTIVE INSULATING STRUCTURE

CROSS-REFERENCE TO RELATED APPLICATIONS

This application claims the benefit of U.S. Provisional Application No. 60/890,056, filed Feb. 15, 2007, and U.S. Provisional Application No. 60/903,904, filed Feb. 28, 2007, both of which are incorporated by reference herein in its entirety.

TECHNICAL FIELD

This application discloses various microwave energy interactive structures for heating, browning, and/or crisping a food item in a microwave oven.

BACKGROUND

Microwave ovens have become a principle form of heating food in a rapid and effective manner. Various attempts have been made to provide microwave food materials, structures, and packages that produce effects associated with foods cooked in a conventional oven. Such materials, structures, and packages must be capable of controlling the distribution of energy around the food item, utilizing the energy in the most efficient manner, and ensuring that the food item and the material, structure, or package has a pleasant and acceptable appearance.

BRIEF DESCRIPTION OF THE DRAWINGS

The description refers to the accompanying drawings, some of which are schematic, in which like reference characters refer to like parts throughout the several views, and in which.

SUMMARY

Figure 1A:
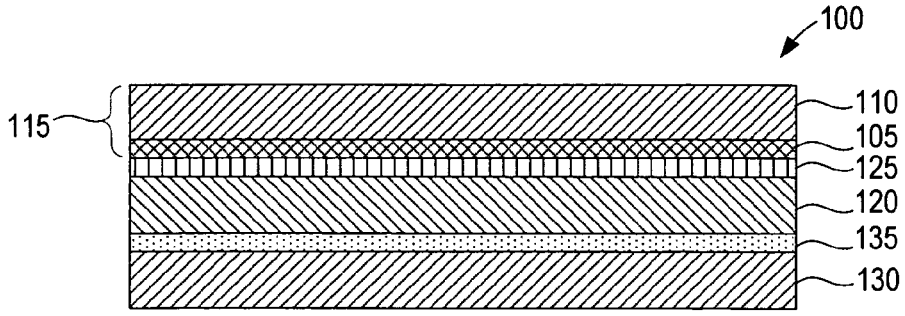
FIG. 1A schematically illustrates a cross-sectional view of an microwave energy interactive structure according to various aspects of the invention.

This application generally discloses various microwave energy interactive structures or materials. The structures may be used to form heating sheets, sleeves, disks, trays, cartons, pouches, packages, and other constructs (collectively "constructs") that enhance the heating, browning, and/or crisping of a food item in a microwave oven. The various structures generally comprise a plurality of components or layers assembled and/or joined to one another in a facing, substantially contacting, layered configuration. Such layers may include a microwave energy interactive element and a tie layer joining a pair of adjacent layers. The tie layer may comprise a thermoplastic material.

Typically, the microwave energy interactive element comprises a thin layer of microwave energy interactive material (i.e., a "susceptor") (generally less than about 100 angstroms in thickness, for example, from about 60 to about 100 angstroms in thickness) that tends to absorb at least a portion of impinging microwave energy and convert it to thermal energy (i.e., heat) at the interface with a food item. Susceptors often are used to promote browning and/or crisping of the surface of a food item. The susceptor may be supported on a microwave energy transparent substrate, for example, a layer of paper or polymer film for ease of handling and/or to prevent contact between the microwave energy interactive material and the food item.

Upon sufficient exposure to microwave energy, the structure transforms from a substantially flattened, planar structure to a multi-dimensional structure having an irregular surface. In this transformed state, the structure is capable of providing some degree of thermal insulation between the food item and the microwave heating environment and, therefore, may be referred to as a "microwave energy interactive insulating structure", "microwave energy interactive insulating material", "insulating material", or "insulating structure".

In one particular aspect, the microwave energy interactive insulating structure comprises a layer of microwave energy interactive material supported on a first polymer film, a support layer joined to the layer of microwave energy interactive material, a second polymer film in a superposed relationship with the support layer such that the support layer is disposed between the layer of microwave energy interactive material and the second polymer film, and a tie layer joining the support layer to the second polymer film layer. The tie layer comprises a thermoplastic material. Upon sufficient exposure to microwave energy, the support layer and the second polymer film at least partially separate from one another to define at least one insulating void between the support layer and the second polymer film, for example, in the tie layer.

The tie layer may be formed in numerous ways and may have various configurations and/or compositions. In one example, tie layer is substantially continuous. In another example, the tie layer includes at least one area having a first bond strength and at least one area having a second bond strength greater than the first bond strength. In still another example, the tie layer comprises at least one material that does not soften at the softening temperature of the thermoplastic material. Such material may be thermoplastic and have a higher softening point or may be thermosetting, such that it has no softening point. In still another example, the thermoplastic material has an affinity for each of the support layer and the second polymer film, and the tie layer comprises at least one other material that has an affinity for at least one of the support layer and the second polymer film that differs from the respective affinity of the thermoplastic material.

In another aspect, a method of making a microwave energy interactive insulating structure includes joining a support layer to a susceptor film, and joining a polymer film to the support layer to define a bonded area, where the bonded area is adapted to at least partially weaken in response to heat. In one variation, joining the polymer film to the support layer defines a second bonded area adapted to remain intact in response to heat.

In one variation, joining the polymer film to the support layer comprises extruding a tie layer material onto the support layer and bringing the polymer film into contact with the tie layer material. If desired, the interior surface of the polymer film may be printed before joining the polymer film to the support layer.

In another variation, joining the polymer film to the support layer comprises applying a tie layer material between the polymer film and the support layer to form the bonded area of the structure, and the method further comprises passing the structure through a patterned nip assembly to define an area having a first bond strength and an area having a second bond strength greater than the first bond strength.

In still another variation, joining the polymer film to the support layer comprises forming a tie layer between the polymer film and the support layer, where the tie layer includes a first component that softens at a first softening temperature and a second component that does not soften at the softening temperature of the first component.

In yet another variation, joining the polymer film to the support layer comprises forming a tie layer between the polymer film and the support layer, where the tie layer includes a thermoplastic material having an affinity for each of the support layer and the polymer film, and at least one other material having an affinity for at least one of the support layer and the polymer film that differs from the respective affinity of the thermoplastic material.

Various other aspects, features, and advantages of the present invention will become apparent from the following description and accompanying figures.

DESCRIPTION

Some aspects of the present disclosure may be understood further by referring to the figures. For simplicity, like numerals may be used to describe like features. It will be understood that while various exemplary embodiments are shown and described in detail herein, any of the features may be used in any combination, and that such combinations are contemplated by the invention.

FIG. 1A depicts a schematic cross-sectional view of an exemplary insulating structure or material 100. The insulating structure 100 includes a layer of microwave energy interactive material 105 supported on a first polymer film layer 110 or other substrate to collectively define a susceptor film or simply "susceptor" 115. A support layer or simply "support" 120, which may be a moisture-providing layer, is joined to the microwave energy interactive material 105 using a layer of adhesive 125 or other suitable material. A substantially continuous tie layer 135 joins the second polymer film layer 130 to the support layer 120.

While not wishing to be bound by theory, it is believed that upon sufficient exposure to microwave energy, the temperature of the microwave energy interactive material 105 increases, thereby causing water vapor to be released and/or generated by the support layer 120. At the same time, the tie layer 135 tends to soften, thereby weakening the bond between the second polymer film layer 130 and the support layer 120.

Figure 1B:
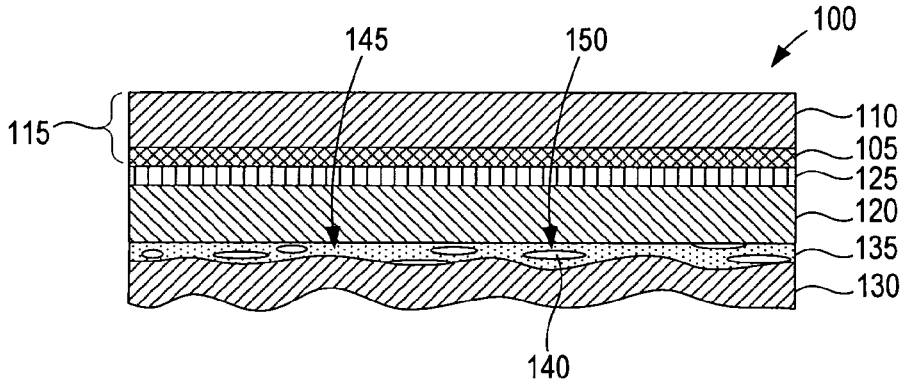
FIG. 1B schematically illustrates the structure of FIG. 1A after sufficient exposure to microwave energy.

Depending on the degree of softening of the tie layer 135, the local and overall bond strength of the tie layer 135, the accompanying loss of adhesion between the second polymer film 130 and the moisture-providing support layer 120, and various other factors, the water vapor (and any other gases) released and/or generated by the support layer 120 may exert a pressure on the tie layer 135 and/or the second polymer film 130, thereby creating one or more voids, cells, or bubbles (collectively "voids") 140 between the support layer 120 and the polymer film layer 130 (e.g., in or adjacent to the tie layer 135), as shown in FIG. 1B. As a result, the structure 100 may be transformed from a somewhat flattened structure into an irregular, multi-dimensional structure having a somewhat wrinkled or textured appearance. The somewhat random or unpredictable manner in which this occurs may cause the polymer film layer 130 to appear stretched in some areas and shrunken in others, thereby creating a somewhat wrinkled or textured appearance. As shown in FIG. 1B, the voids 140 can be formed in the tie layer so that one or more of the voids 140 is spaced apart from (e.g., free from contact with) the support layer 120, the second polymer film 130, or both.

In this wrinkled or textured, multi-dimensional configuration, the insulating structure 100 may enhance the heating, browning, and/or crisping of a food item in a microwave oven. First, any water vapor, air, and other gases contained in the voids 140 may provide insulation between the food item and the ambient environment of the microwave oven, thereby increasing the amount of sensible heat that stays within or is transferred to the food item. Further, the wrinkling and/or deforming of the structure 100 may cause the structure to conform more closely to the surface of the food item, thereby placing the microwave energy interactive material 105 into closer proximity with the food item and enhancing the browning and/or crisping of the surface of the food item.

When exposure to microwave energy ceases, the softened tie layer 135 material cools and eventually solidifies with at least some of the previously formed voids 140 between the support layer 120 and the second polymer film layer 130 intact in the solidified structure. In some instances, the voids 140 may provide a surface for safe and comfortable handling of the heated food item and also may help to retain heat within the package to keep the food item warm. As a result, the insulating structures of the invention may be used to form multi-functional packages (e.g., sleeves, pouches, wrappers, etc.) and other constructs that can be used to store, heat, brown, crisp, transport, and contain a food item.

If desired, the structure 100 may be formed and/or processed to selectively strengthen or weaken the bond between the support layer 120 and the second polymer film 130 to promote a desired degree of void 140 formation in the tie layer 135. Such strengthening or weakening may be made to be inherent in the tie layer 135 or may be the result of processing the structure 100 to mechanically or chemically strengthen or weaken particular areas of the tie layer 135. As a result, the areas of the tie layer 135 having a greater bond strength 145 are more likely to remain intact than areas of the tie layer 135 having a weaker bond strength 150, as illustrated schematically in FIG. 1B.

In one example, selected areas of the structure may be strengthened using a patterned nip assembly or other suitable apparatus that can be configured to create areas of no nip pressure, low nip pressure, medium nip pressure, and high nip pressure that result in areas having increasing degrees of bond strength. In this manner, the degree of void formation in the tie layer can be better controlled to meet the heating, browning, and/or crisping requirements for a particular food item and/or heating application.

In another example, areas of greater and lesser strength can be created by forming a tie layer with various components or materials having differing properties. For example, the tie layer may include materials having different softening points. As another example, the tie layer may include materials having different affinities for the support layer and/or second polymer layer. In such examples, voids may form in areas of the tie layer material having a lower softening point or lesser affinity, while voids may form at a higher temperature or later in the heating process in areas of the tie layer having a higher softening point or affinity, or may not form at all. Numerous other techniques for modifying the behavior of the tie layer are contemplated by the invention.

It will be evident that any of the various techniques described above may result in the formation of any size, shape, and configuration of voids in the tie layer. In each of various examples, each void independently may have a major linear dimension of from about 0.05 to about 0.1 in., from about 0.1 to about 0.25 in., from about 0.25 to about 3 in., for example, from about 0.25 to about 0.5 in., from about 0.5 to about 0.75 in., from about 0.75 to about 1 in., from about 1 to about 1.25 in., from about 1.25 to about 1.5 in., from about 1.5 to about 1.75 in., from about 1.75 to about 2 in., from about 2 to about 2.25 in., from about 2.25 to about 2.5 in., from about 2.5 to about 2.75 in., from about 2.75 to about 3 in., from about 3 to about 4 in., from about 4 to about 5 in, from about 0.5 to about 1.5 in., from about 1 to about 3 in., or any other dimension.

It is contemplated that, for some heating applications, the amount of water vapor provided by the support layer may be insufficient to provide the desired degree of void formation. In such applications, it may be beneficial to include an additional source of water vapor with the structure, for example, an additional paper or paper-based layer.

Alternatively or additionally, one or more reagents may be used to generate a gas to promote formation of voids. Numerous examples of reagents that may be suitable for use with the present structure are provided in U.S. Patent Application Publication No. 2006/0289521A1, published on Dec. 28, 2006, which is incorporated by reference in its entirety. In one example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis(benzenesulphonylhydrazide), azodicarbonamide, and p-toluenesulfonylsemicarbazide. In another example, the reagent may comprise a hydrated mineral that releases water in response to heat. However, numerous other reagents and released gases may be used.

Figure 2:
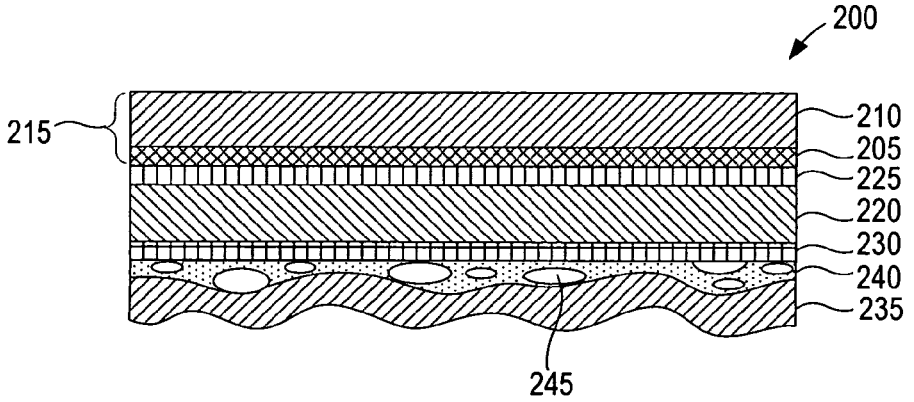
FIG. 2 schematically illustrates a cross-sectional view of another microwave energy interactive structure according to various aspects of the invention.

By way of example, FIG. 2 schematically depicts a microwave energy interactive insulating structure 200 including a layer of microwave energy interactive material 205 supported on a first polymer film 210 to form a susceptor film 215. A support layer 220 is joined to the layer of microwave energy interactive material 205 using a layer of adhesive or other suitable material 225. One or more reagents 230, optionally within a carrier or coating, overlie at least a portion of the support layer 220. A second polymer film 235 is joined releasably to the reagent layer 230 using a substantially continuous tie layer of adhesive, polymer, or other suitable thermoplastic material 240. After sufficient exposure to microwave energy, water vapor or other gases are released from or generated by the support layer 220 and the reagent layer 230. This expansion may occur within 1 to 15 seconds in an energized microwave oven, and in some instances, may occur within 2 to 10 seconds. The resulting gas applies pressure on the second polymer film 235 to form a plurality of insulating voids 245.

In another example (not shown), the support layer 220 may be omitted. Even without a paper or paperboard layer, the water vapor or other gas provided by the reagent may be sufficient both to form the insulating voids and to absorb any excess heat from the microwave energy interactive material. In still another example (not shown), the reagent layer 203 may lie between the layer of microwave energy interactive material 205 and the support layer 220. Numerous other examples are encompassed hereby.

If desired, multiple layers or sheets of insulating structures may be used to provide enhanced thermal insulation and, therefore, enhanced browning and/or crisping. The various sheets of similar and/or dissimilar insulating structures may be superposed in any configuration as needed or desired for a particular application. For example, the sheets may be arranged so that their respective susceptor film layers are facing away from each other, towards each other, or in any other manner. The sheets may remain separate or may be joined using any suitable process or technique, for example, thermal bonding, adhesive bonding, ultrasonic bonding or welding, mechanical fastening, or any combination thereof. If the greatest degree of wrinkling or deforming is desirable, it might be beneficial to use a discontinuous, patterned adhesive bond that will not restrict the expansion and flexing of the layers within each structure. In contrast, where structural stability is desirable, a continuous adhesive bond between sheets might provide the desired result.

Typically, the susceptor film serves as a food-contacting side or surface, while the polymer film adjacent to the tie layer serves as an outer surface of a package or other construct formed. In some instances, it may be desirable to print advertising, product information, heating instructions, or other indicia on the outer side of a package. Thus, if desired, the outer side or surface of the polymer film adjacent to the tie layer may be printed with such information (generally referred to as "printed matter"). Alternatively, the opposite side of the polymer film (i.e., the inner side or surface facing the support layer) may be reverse printed prior to being joined to the support layer. This advantageously provides optimal print clarity that cannot typically be achieved by printing directly onto the support, particularly when the support layer is formed from paper or any other material that commonly is prone to ink bleeding.

Any of the various layers of the structures and constructs encompassed by the invention may be formed from various materials, provided that the materials are substantially resistant to softening, scorching, combusting, or degrading at typical microwave oven heating temperatures, for example, at from about 250° F. to about 425° F. The particular materials used may include microwave energy interactive materials, for example, those used to form susceptors and other microwave energy interactive elements, and microwave energy transparent or inactive materials, for example, those used to form the polymer film layers and support layer.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In each of various particular examples, the barrier film may have an OTR of less than about 10 $cc/m^2/day$, less than about 1 $cc/m^2/day$, less than about 0.5 $cc/m^2/day$, less than about 0.1 $cc/m^2/day$, or any other suitable OTR or range of OTR's.

The barrier film may have a water vapor transmission rate (WVTR) of less than about 100 $g/m^2/day$ as measured using ASTM F1249. In each of various particular examples, the barrier film may have a WVTR of less than about 50 $g/m^2/day$, less than about 15 $g/m^2/day$, less than about 1 $g/m^2/day$, less than about 0.1 $g/m^2/day$, less than about 0.05 $g/m^2/day$, or any other suitable WVTR or range of WVTR's.

Other non-conducting substrate materials such as metal oxides, silicates, cellulosics, or any combination thereof, also may be used in accordance with the present invention.

Likewise, the second polymer film may be any suitable polymer film including, but not limited to, those described above. In one example, the second polymer film layer comprises polyethylene terephthalate. The second polymer film layer may have any suitable thickness, and in each of various examples, the second polymer film layer may have a thickness of from about 20 to about 70 gauge, from about 30 to about 60 gauge, from about 40 to about 50 gauge, from about 45 to about 55 gauge, or about 48 gauge. In one particular example, the second polymer film layer comprises polyethylene terephthalate having a thickness of about 48 gauge.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683. Although particular examples of patterns of microwave energy interactive material are shown and described herein, it should be understood that other patterns of microwave energy interactive material are contemplated by the present invention.

The support layer typically may comprise any suitable moisture-containing layer. In some instances, the support layer is a dimensionally stable layer. However, where a reagent layer is used in conjunction with the support layer, the support layer may comprise any material, for example, a polymer film. In one example, the support layer comprises a paper or paper-based material generally having a basis weight of from about 15 to about 60 lbs/ream (lb/300 sq. ft.), for example, from about 20 to about 40 lbs/ream. In one particular example, the paper has a basis weight of about 25 lbs/ream.

The tie layer may comprise any suitable thermoplastic material that is capable of joining, bonding, or adhering two layers together. As used herein, the term "thermoplastic" refers to any polymeric or non-polymeric material that is capable of becoming soft and/or pliable when heated, without a substantial change of the inherent properties of the material. In some examples, the tie layer may comprise a thermoplastic polymer based on, for example, a polyolefin, a polyamide, a polyester; a thermoplastic elastomer; any combination or copolymer of such materials; or any other suitable material. In some particular examples, the tie layer may comprise polypropylene, polyethylene, low density polyethylene, or any combination or copolymer thereof.

The tie layer generally may have a softening temperature that is less than about 425° F. In each of various examples, one or more components of the tie layer may have a softening point of from about 75° F. to about 100° F., from about 100° F. to about 125° F., from about 125° F. to about 150° F., from about 150° F. to about 175° F., from about 175° F. to about 200° F., from about 200° F. to about 250° F., from about 250° F. to about 275° F., from about 275° F. to about 300° F., from about 300° F. to about 325° F., from about 325° F. to about 350° F., from about 350° F. to about 375° F., from about 375° F. to about 400° F., from about 400° F. to about 425° F., from about 100° F. to about 400° F., from about 150° F. to about 350° F., from about 200° F. to about 300° F., or any other suitable range or combination of ranges of temperatures.

The tie layer may have any suitable basis weight and may be formed in any suitable manner. In one example, the tie layer has a basis weight or dry coat weight of from about 3 to about 18 lb/ream. In another example, the tie layer has a dry coat weight of from about 5 to about 15 lb/ream. In another example, the tie layer has a dry coat weight of from about 8 to about 12 lb/ream. However, other basis weights or dry coat weights are contemplated by the invention.

The particular process used to form the tie layer may vary depending on the particular application. Examples of processes that may be used include, but are not limited to, spraying, roll coating, extrusion lamination, or any other process.

If desired, one or more pigments or opacifying agents (generally referred to herein as "colorants") may be added to the tie layer to alter or enhance the appearance of the resulting structure. For example, one or more colorants may be added to the tie layer to mask the often grey appearance of the microwave energy interactive material that may be visible through the other side of the support layer. Examples of colorants that may be suitable for use in this manner include titanium dioxide ($TiO_2$), carbon black, or any combination thereof.

The colorant may be added in any amount needed or desired for a particular application, generally from about 1 wt % to about 15 wt % of the tie layer. In each of various examples, the colorant may be added in an amount of from about 1 to about 5 wt %, from about 3 to about 7 wt %, from about 5 to about 10 wt %, from about 7 to about 12 wt %, or from about 10 to about 15 wt %. In each of various other examples, the colorant may be added in an amount of from about 1 to about 1.5 wt %, from about 1.5 to about 2 wt %, from about 2 to about 2.5 wt %, from about 2.5 to about 3 wt %, from about 3 to about 3.5 wt %, from about 3.5 to about 4 wt %, from about 4 to about 4.5 wt %, from about 4.5 to about 5 wt %, from about 5 to about 5.5 wt %, from about 5.5 to about 6 wt %, from about 6 to about 6.5 wt %, from about 6.5 to about 7 wt %, from about 7 to about 7.5 wt %, from about 7.5 to about 8 wt %, from about 8 to about 8.5 wt %, from about 8.5 to about 9 wt %, from about 9 to about 9.5 wt %, from about 9.5 to about 10 wt %, from about 10 to about 10.5 wt %, from about 10.5 to about 11 wt %, from about 11 to about 11.5 wt %, from about 11.5 to about 12 wt %, from about 12 to about 12.5 wt %, from about 12.5 to about 13 wt %, from about 13 to about 13.5 wt %, from about 13.5 to about 14 wt %, from about 14 to about 14.5 wt %, from about 14.5 to about 15 wt %, or any other suitable amount.

Various aspects of the invention may be illustrated further by way of the following examples, which are not to be construed as limiting in any manner.

EXAMPLES 1-4

Printed 48 gauge polyethylene terephthalate (PET) film was laminated to MICROFLEX Q® susceptor material (described above) using BR-3482 water based adhesive applied (commercially available from Royal Adhesives, LLC) with a No. 8 Meyer rod. The laminated materials were allowed to dry at ambient conditions for about 24 hours. After drying, some of the samples were cut into 1" strips to evaluate the bond quality using a Dixie adhesion tester. The results are presented in Table 1.

TABLE 1

| Ex. | Printed PET | Bond strength (g/in.) | Printing/adhesion quality |
|---|---|---|---|
| 1 | Solid green backed by white | 350-400 | Poor; almost complete transfer of the ink from the PET to the MICROFLEX Q susceptor material |
| 2 | Blue vignette backed by white | 450-500 | Very good; no ink transfer from PET to the MICROFLEX Q susceptor material |
| 3 | Process pictorial backed by white | 500-800 | Good; slight ink transfer to the MICROFLEX Q susceptor material |
| 4 | White only | 100-125 | Fair; some ink transfer to the MICROFLEXQ susceptor material |

Various samples then were evaluated for performance in a microwave oven. Each laminate was cut into a sample about 100 mm by 100 mm in size. The corners of each sample were taped to a piece of board stock to prevent the sample from folding over on itself in the microwave. Each sample was heated for 10 seconds in a 1000 W microwave oven with a 700 ml competing water load. The samples were visually judged for performance. As expected, each sample exhibited varying degrees of delamination and insulating void formation.

EXAMPLE 5

A 48 gauge metallized PET susceptor film was coated with a moisture-releasing reagent coating using two roll coating stations, as set forth in Table 2. Samples were prepared at 250 feet per minute (fpm) and 200 fpm.

TABLE 2

| | Coating station 1 | Coating station 2 |
|---|---|---|
| Approx. capacity (gal) | 65 | 68 |

TABLE 2-continued

| | Coating station 1 | Coating station 2 |
|---|---|---|
| Basis | 3 barrels, 300 lb MgHPhosphate hydrate | 1.5 barrels, 150 lb MgHPhosphate hydrate |
| Water | 100 lbs (12 gal) | 150 lbs (18 gal) |
| Airflex 460 Adhesive (Air Products) | 335 lbs (40 gal) | 355 lbs (43 gal |
| Mg H P04*3H20 (Jost Chemical) | 300 lbs (2.5 100 lb barrels) | 150 lbs (2 100 lb barrels) |
| Hydrad C hydrated alumina filler (J. M. Huber) | -0- | 100 lbs (2 bags @50 lb) |
| Michemlube 160 wax (Michelaman, Inc.) | -0- | 12 lbs (1.5 gal) |

The resulting material was laminated to 20 lb/ream bleached Kraft paper using a solventless coater and a two part urethane adhesive. The paper side of the resulting structure was then laminated to a reverse printed 48 gauge PET film (printed with laminating inks) using a tie layer coating of 7 lbs/ream of a blend of 85% low density polyethylene and 15% polypropylene.

Various properties of the resulting samples were measured. The results are presented in Table 3.

TABLE 3

| | Sample 1 | Sample 2 |
|---|---|---|
| Coating speed (fpm) | 200 | 250 |
| Reagent layer coat weight (lb/ream) | 14.7 | 13.1 |
| % Moisture release in microwave oven after 3 sec | 6.65 | 7.77 |
| % Shrinkage in microwave oven after 3 sec | 78 | 71 |

Additionally, each sample was used to heat Healthy Choice® tomato basil Panini sandwiches, raw pastry dough, and Hot Pockets® pastry sandwiches in a household microwave oven. In each example, the experimental insulating structure achieved a greater degree of browning and/or crisping than a plain susceptor paper.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is not intended nor is to be construed to limit the present invention or otherwise to exclude any such other embodiments, adaptations, variations, modifications, and equivalent arrangements of the present invention.

What is claimed is:

1. A microwave energy interactive structure comprising:

a support layer having a first side and a second side opposite one another;

a susceptor film joined to the first side of the support layer, the susceptor film comprising a layer of microwave energy interactive material supported on a first polymer film, wherein the susceptor film is joined to the first side of the support layer so that the layer of microwave energy interactive material is positioned between the first polymer film and the first side of the support layer; and a second polymer film joined to the second side of the support layer, the second polymer film being joined to the second side of the support layer by a substantially continuous tie layer, wherein the tie layer comprises a thermoplastic material, and wherein a void forms within the tie layer in response to microwave energy, and the void is spaced apart from at least one of the support layer and the second polymer film within the tie layer so that a portion of the thermoplastic material of the tie layer is disposed between the void and the at least one of the support layer and the second polymer film.

2. The structure of claim 1, wherein the susceptor film remains joined to the first side of the support layer when the void is formed in the tie layer.

3. The structure of claim 1, wherein the void is a thermal insulating void.

4. The structure of claim 3, wherein the thermal insulating void is a first thermal insulating void of a plurality of thermal insulating voids formed within the tie layer.

5. The structure of claim 1, wherein the tie layer includes an area having a first bond strength, and an area having a second bond strength greater than the first bond strength, wherein the void forms proximate to the first area.

6. The structure of claim 1, wherein the thermoplastic material has a softening temperature, and the tie layer comprises at least one other material that does not soften at the softening temperature of the thermoplastic material.

7. The structure of claim 6, wherein the thermoplastic material is a first thermoplastic material, and the other material is a second thermoplastic material having a softening temperature greater than the softening temperature of the first thermoplastic material, wherein the void forms proximate to the first thermoplastic material.

8. The structure of claim 6, wherein the void forms proximate to the thermoplastic material.

9. The structure of claim 1, wherein the thermoplastic material has an affinity for each of the support layer and the second polymer film, and the tie layer comprises at least one other material that has an affinity for at least one of the support layer and the second polymer film that differs from the respective affinity of the thermoplastic material.

10. The structure of claim 1, wherein the thermoplastic material comprises a polymer.

11. The structure of claim 10, wherein the polymer is selected from the group consisting of a polyolefin, a polyamide, a polyester, a thermoplastic elastomer, any copolymer thereof, and any combination thereof.

12. The structure of claim 10, wherein the polymer is selected from the group consisting of polypropylene, polyethylene, low density polyethylene, any copolymer thereof, and combination thereof.

13. The structure of claim 1, wherein the tie layer further comprises a colorant in an amount of from about 1 wt % to about 15 wt % of the tie layer.

14. The structure of claim 13, wherein the colorant is selected from the group consisting of titanium dioxide, carbon black, and any combination thereof.

15. The structure of claim 1, wherein the support layer is a moisture-providing layer.

16. The structure of claim 15, wherein the support layer comprises paper, paperboard, or any combination thereof.

17. The structure of claim 1, further comprising a reagent layer including at least one reagent that generates a gas in response to heat.

18. The structure of claim 17, wherein the reagent layer is disposed between the support layer and the second polymer film.

19. The structure of claim 17, wherein the reagent layer is disposed between the layer of microwave energy interactive material and the support layer.

20. The structure of claim 1, wherein the second polymer film includes a first side facing the support layer and a second side opposite the first side, and the first side of the second polymer film includes printed matter.

21. A method of making the structure of claim 1, the method comprising:

joining the layer of microwave energy interactive material of the susceptor film to the first side of the support layer with the substantially continuous layer of adhesive; and joining the second polymer film to the second side of the support layer.

22. The method of claim 21, wherein joining the second polymer film to the second side of the support layer comprises extruding the tie layer onto the second side of the support layer, and bringing the second side of the second polymer film into contact with the tie layer.

23. The method of claim 22, wherein the method further comprises passing the structure susceptor film, support layer, tie layer, and second polymer film through a patterned nip assembly to define an area having a first bond strength and an area having a second bond strength greater than the first bond strength, wherein the void forms proximate to the area having the first bond strength.

24. The method of claim 21, wherein joining the second polymer film to the second side of the support layer comprises forming the tie layer between the second polymer film and the second side of the support layer.

25. The method of claim 24, wherein the method further comprises passing the susceptor film, support layer, tie layer, and second polymer film through a patterned nip assembly to define an area having a first bond strength and an area having a second bond strength greater than the first bond strength, wherein the void forms proximate to the area having the first bond strength.

26. The method of claim 21, wherein the second polymer film includes a first surface facing the support layer and a second surface opposite the first surface, and the method further comprises printing the first surface of the second polymer film before joining the second polymer film to the support layer.

27. A microwave energy interactive structure comprising:

a support layer having a first side and a second side opposite one another;

a susceptor film joined to the first side of the support layer, the susceptor film comprising a layer of microwave energy interactive material supported on a first polymer film, wherein the susceptor film is joined to the first side of the support layer so that the layer of microwave energy interactive material is positioned between the first polymer film and the first side of the support layer; and a second polymer film joined to the second side of the support layer, the second polymer film being joined to the second side of the support layer by a tie layer having a thickness, wherein the tie layer comprises a first polymer and a second polymer, and wherein a void forms within the tie layer proximate to the first polymer in response to microwave energy, and the void is spaced apart from at least one of the support layer and the second polymer film in the tie layer so that a portion of the first polymer is disposed between the void and the at least one of the support layer and the second polymer film.

28. The structure of claim 27, wherein the first polymer and the second polymer each have a softening temperature, and the softening temperature of the first polymer is less than the softening temperature of the second polymer.

29. A microwave energy interactive structure comprising:

a support layer having a first side and a second side opposite one another;

a susceptor film joined to the first side of the support layer, the susceptor film comprising a layer of microwave energy interactive material supported on a first polymer film, wherein the susceptor film is joined to the first side of the support layer so that the layer of microwave energy interactive material is positioned between the first polymer film and the first side of the support layer; and a second polymer film joined to the second side of the support layer by a substantially continuous tie layer having a thickness, the second polymer film being joined to the second side of the support layer by the tie layer to define areas having a first bond strength of the tie layer and areas having a second bond strength greater than the first bond strength, wherein voids form within the tie layer proximate to the areas having the first bond strength in response to microwave energy, and wherein the voids are spaced apart from at least one of the support layer and the second polymer film in the tie layer so that a portion of the tie layer is disposed between the void and the at least one of the support layer and the second polymer film.

30. The structure of claim 29, wherein the areas having the second bond strength are defined by applying pressure to the susceptor film, support layer, tie layer, and second polymer film.

31. The structure of claim 27, wherein the first polymer is a thermoplastic polymer, and the second polymer is a thermoset polymer.

32. The structure of claim 27, wherein the first polymer and the second polymer each have an affinity for each of the support layer and the second polymer film, and the affinity of the first polymer for at least one of the support layer and the second polymer film differs from the respective affinity of the second polymer for the at least one of the support layer and the second polymer film.

33. The structure of claim 27, wherein the susceptor film remains joined to the first side of the support layer when the void is formed within the tie layer.

34. The structure of claim 33, wherein the void is a first void of a plurality of voids formed within the tie layer.

35. The structure of claim 27, wherein the support layer comprises moisture.

36. The structure of claim 27, wherein the support layer comprises at least one of paper, paperboard, or a polymer film.

37. The structure of claim 29, wherein the susceptor film remains joined to the first side of the support layer when the voids are formed in the tie layer.

38. The structure of claim 29, wherein the support layer comprises moisture.

39. The structure of claim 29, wherein the support layer comprises at least one of paper, paperboard, or a polymer film.

40. A method of making the structure of claim 29, the method comprising:

joining the layer of microwave energy interactive material of the susceptor film to the first side of the support layer with the substantially continuous layer of adhesive; and joining the second polymer film to the second side of the support layer.

41. The method of claim 40, wherein joining the second polymer film to the second side of the support layer comprises extruding the tie layer onto the second side of the support layer, and bringing the second side of the second polymer film into contact with the tie layer.

42. The method of claim 41, wherein the method further comprises passing the structure susceptor film, support layer, tie layer, and second polymer film through a patterned nip assembly to define the areas having the first bond strength and the areas having the second bond strength.

43. The method of claim 40, wherein joining the second polymer film to the second side of the support layer comprises forming the tie layer between the second polymer film and the second side of the support layer.

44. The method of claim 43, wherein the method further comprises passing the susceptor film, support layer, tie layer, and second polymer film through a patterned nip assembly to define the areas having the first bond strength and the areas having the second bond strength.

45. A microwave energy interactive structure comprising:

a support layer having a first side and a second side opposite one another;

a susceptor film joined to the first side of the support layer, the susceptor film comprising a layer of microwave energy interactive material supported on a first polymer film, wherein the susceptor film is joined to the first side of the support layer so that the layer of microwave energy interactive material is positioned between the first polymer film and the first side of the support layer; and a second polymer film joined to the second side of the support layer, the second polymer film being joined to the second side of the support layer by a substantially continuous tie layer, wherein the tie layer comprises a thermoplastic material, wherein at least one void forms within the tie layer in response to microwave energy, and wherein the at least void is free from contact with at least one of the support layer and the second polymer film within the tie layer so that a portion of the thermoplastic material of the tie layer is disposed between the at least one void and the at least one of the support layer and the second polymer film.

* * * * *